United States Patent [19]

Thompson et al.

[11] Patent Number: 4,775,012

[45] Date of Patent: Oct. 4, 1988

[54] FIRE EXTINGUISHER WHICH UTILIZES A CAN OF PRESSURIZED BEVERAGE

[76] Inventors: R. Maxwell Thompson, Rte. 12, Box 72, Fredericksburg, Va. 22405; C. Julian Sledd, P.O. Box 412, Powhatan, Va. 23139

[21] Appl. No.: 64,684

[22] Filed: Jun. 22, 1987

[51] Int. Cl.[4] ..... A62C 13/24

[52] U.S. Cl. ..... 169/74; 169/71; 222/83.5

[58] Field of Search ..... 169/30, 71, 72, 74, 169/89, 91; 222/81, 83, 83.5, 88, 89; 239/309, 272; 220/277, 278, 903, 85 H, 85 SP, 88 R, 88 B; 206/601, 603

[56] References Cited

U.S. PATENT DOCUMENTS

| | | | |
|---|---|---|---|
| 1,069,388 | 8/1913 | Colwell | 222/83 |
| 1,366,714 | 1/1921 | Burkert | 222/83.5 |
| 1,474,077 | 11/1923 | Grundhand et al. | 222/83.5 |
| 1,960,152 | 5/1934 | Grundhand et al. | 222/83.5 |
| 2,040,484 | 5/1936 | Hathaway | 222/89 |
| 2,179,772 | 11/1939 | Willis | 222/83 |
| 2,759,634 | 8/1956 | O'Neill | 222/83 |
| 3,134,506 | 5/1964 | Way | 222/89 X |
| 3,168,219 | 2/1965 | Kamp | 169/71 X |
| 3,172,478 | 3/1965 | Giclas | 222/83 X |

FOREIGN PATENT DOCUMENTS

| | | | |
|---|---|---|---|
| 1030087 | 6/1953 | France | 169/74 |

*Primary Examiner*—Joseph F. Peters, Jr.
*Assistant Examiner*—James M. Kannofsky
*Attorney, Agent, or Firm*—Norman B. Rainer

[57] ABSTRACT

A device is provided which enables a carbonated beverage in a can to function as a fire extinguishant fluid. The device has a confining compartment having a bottom and a resilient sidewall, and is dimensioned to make a close-fitting gripping engagement with a standard beverage can. By squeezing the sidewall with the can in place, the can is punctured, and the emergent beverage is caused to exit through a nozzle directed above the top of the can.

8 Claims, 1 Drawing Sheet

FIRE EXTINGUISHER WHICH UTILIZES A CAN OF PRESSURIZED BEVERAGE

BACKGROUND OF THE INVENTION

This invention relates to fire extinguishers, and more particularly concerns a device for holding a can of pressurized beverage and causing said beverage to be emitted from the can as a directed spray serving as a fire-extinguishing fluid.

Numerous types of hand-held fire extinguishers have been disclosed in the prior art. One type, as disclosed in U.S. Pat. Nos. 2,567,344 and 1,794,451 utilizes bottles of carbonated beverages as the fire extinguishant. Such devices generally employ means for penetrating or opening the closure means of the beverage bottle, and are transferrable to subsequent bottles.

Although the carbonated beverages perform well as fire extinguishing agents if rapidly applied, prior devices utilizing carbonated beverages have been too slow to activate and too slow in transferring to a subsequent container of the carbonated beverage. Improvements have also been sought in the spraying accuracy of such devices, and in utilizing such devices with carbonated beverages in can containers.

It is accordingly an object of the present invention to provide a device which will confine a can of carbonated beverage and cause said beverage to be rapidly emitted from the can as a directed spray.

It is another object of this invention to provide a device as in the foregoing object which permits rapid confinement and removal of said can.

It is a further object of the present invention to provide a device of the aforesaid nature amenable to single hand operation.

It is still a further object of this invention to provide a device of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a dispenser device comprising:

(a) a confining compartment having bottom retaining means and an elongated resilient sidewall disposed about said bottom retaining means and extending upwardly therefrom to an upper rim extremity, said sidewall being bounded by interior and exterior surfaces and having a substantially uniform arcuate cross-sectional configuration taken perpendicularly to its axis of elongation, and having a gap oriented in parallel relationship to said axis and perpendicular to said bottom retaining means, (b) puncturing means associated with said sidewall adjacent said upper rim and adapted to be manually displaced in a direction perpendicular to said axis to puncture the side of a metal beverage can positioned within said confining compartment, said puncturing means having a hollow conduit which permits egress of beverage from said can, (c) compressible sealing means disposed upon the interior surface of said sidewall in association with said puncturing means to prevent egress of beverage from other than said hollow conduit, and (d) an elongated tubular nozzle in parallel disposition to said side wall, having a lower extremity which communicates with said conduit, and an open upper extremity directed above said upper rim.

In operation, a can of carbonated beverage such as beer is shaken vigorously before or after insertion into the confining compartment. The side wall of the confining compartment is then pressed inwardly where the puncturing means is located. Such action causes the can to be penetrated, causing emission of a directed spray of the beverage from the nozzle. When the can is empty, it can be quickly removed and replaced with a full can.

In preferred embodiments of the invention, the confining compartment is of monolithic construction, having been fabricated by injection molding with a plastic such as polyethylene, polypropylene, acrylonitrile-butadiene-styrene interpolymer resins, and equivalent thermoplastic polymers having resilient properties and good resistance to breaking with minor flexing. The sidewall of the confining compartment is preferably of substantially circular cylindrical contour having a diameter slightly larger than standard sized beverage cans. The puncturing means is preferably a pointed tube which also serves as the conduit for egress of beverage. A button-type structure may be positioned upon the exterior surface of the sidewall in association with the puncturing means. The tubular nozzle may be located within the sidewall.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
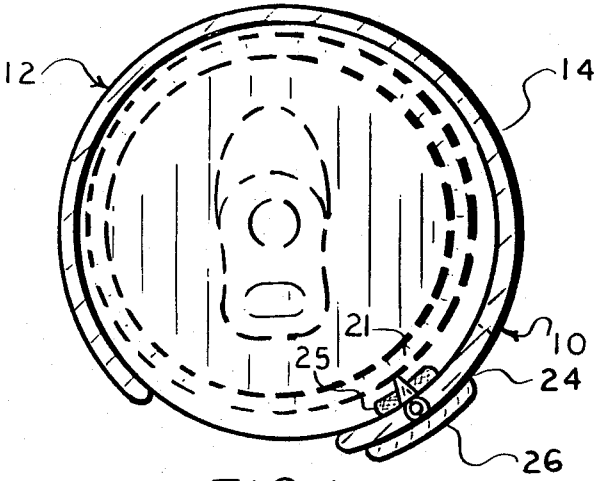
FIG. 1 is a top view of an embodiment of the device of the present invention shown holding a beverage can in a state of readiness.
Figure 2:
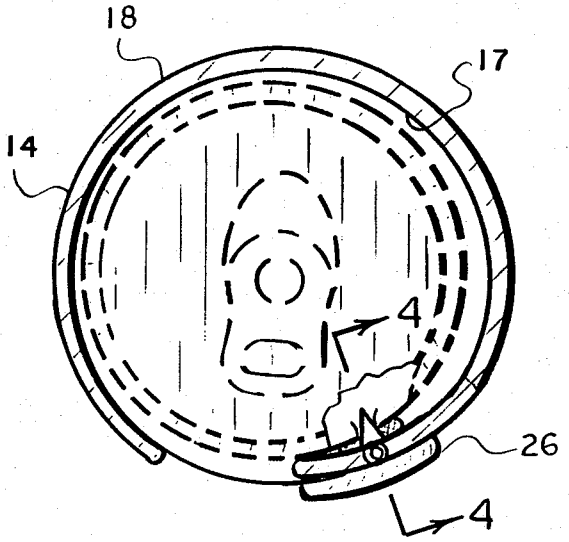
FIG. 2 is a top view of the embodiment of FIG. 1, showing the device in its activated, operational state.
Figure 3:
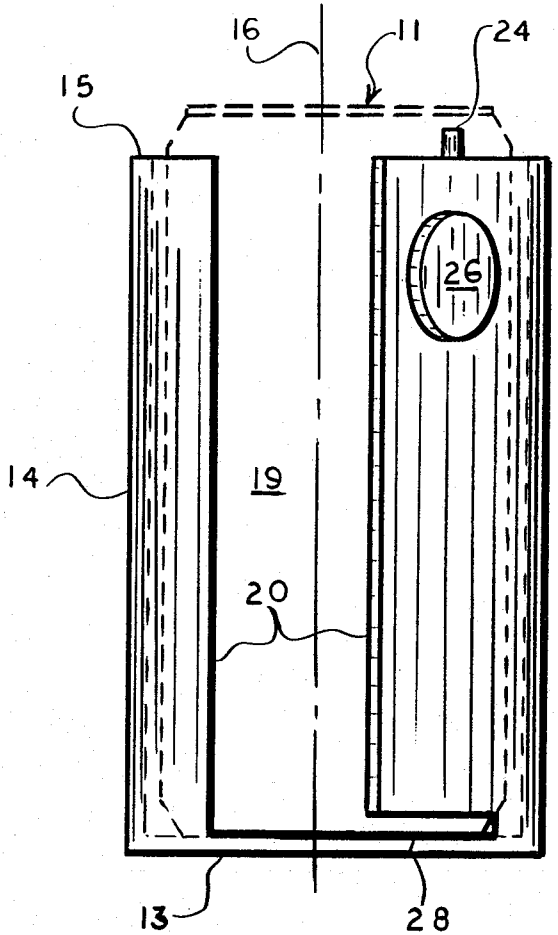
FIG. 3 is a side view of the device of FIG. 1.
Figure 4:
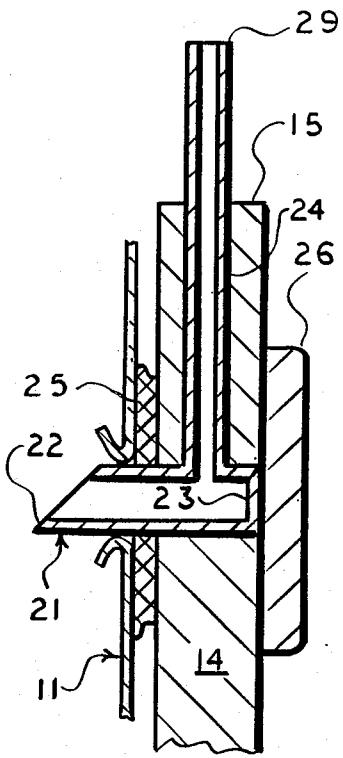
FIG. 4 is an enlarged sectional view taken on the line 4—4 of FIG. 2.

For ease and clarity of description, the terms "upper", "lower", and expressions equivalent thereto will have reference to the upper and lower portions, respectively, of the device as shown in FIG. 3. Similarly, the terms "interior", "exterior", and expressions of equivalent import will have reference to the geometric center of the device as shown in FIG. 1.

DESCRIPTION OF THE PREFERRED EMBODIMENTS

Referring to FIGS. 1–4, an embodiment of the dispenser device 10 of the present invention is shown in operative engagement with a can of beverage 11, said can being of conventional thin walled aluminum construction.

The dispenser device is comprised of confining means 12 of monolithic construction fabricated of resilient thermoplastic polymer by a molding technique and comprised of circular bottom panel 13 and elongated sidewall 14 disposed about the perimeter of said panel and extending upwardly therefrom to upper rim extremity 15. The sidewall has a generally circular cylindrical contour having a center axis 16, and is of substantially uniform thickness, bounded by interior surface 17 and exterior surface 18. A gap 19, defined by parallel edges 20, is disposed within sidewall 14 in parallel relationship to axis 16 and extending between rim 15 and bottom panel 13. The purpose of the gap is to enable the sidewall to flex inwardly when exterior surface 18 is gripped by a single hand and squeezed. The width of the gap, measured between edges 20 may range between about ½" and 2". An optional elongated recess 28 is shown extending along bottom panel 13 and communicating with gap 19. The recess 28 further enhances the flexibility of the sidewall.

The circular diameter of confining means 12 will range between about ¼" and 1" larger than the diameter of can 11. The height of said confining means and the embracing compartment it defines is equal to the height of the can in the exemplified embodiment. In other, equivalent embodiments, however, the height of the confining means may not be equal to the height of the can it embraces.

A puncturing conduit tube 21 having pointed interiorly directed distal extremity 22, and proximal extremity 23 supported by sidewall 14 adjacent rim 15, is radially oriented with respect to axis 16. The length of tube 21 may range between about ½" and 1", and its diameter may range between about ⅛" and ¼". The proximal extremity 23 communicates with elongated nozzle 24 disposed within sidewall 14 in parallel disposition to axis 16, and opening above rim 15.

A compressible sealing collar 25, which may be of cellular resilient polymeric material, is disposed upon tube 21 in tight-fitting engagement therewith.

A button 26, generally flush fitting with exterior surface 18 of sidewall 14, is centered upon the proximal extremity 23 of tube 21.

In operation, a can of carbonated beverage, preferably beer, is placed within confining means 12 after having been shaken, or is shaken while within said confining means. Button 26 is then pressed, causing distal extremity 22 of tube 21 to puncture the can. The beverage then flows through tube 21 and nozzle 24 to emerge as a directed spray from the extremity 29 of said nozzle.

In the exemplified embodiment, nozzle 24 and tube 21 have been incorporated into sidewall 14 in the course of the molding operation that produces confining means 12. Alternative equivalent designs of said nozzle and tube may be utilized. Exterior surface 18 may contain indicia of an advertising nature.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for dispensing carbonated beverage from a can as a directed spray comprising:

(a) a confining compartment having bottom retaining means and an elongated resilient sidewall disposed about said bottom retaining means and extending upwardly therefrom to an upper rim extremity, said sidewall being bounded by interior and exterior surfaces and having a substantially uniform arcuate cross-sectional configuration taken perpendicularly to its axis of elongation, and having a gap oriented in parallel relationship to said axis and perpendicular to said bottom retaining means, (b) puncturing means associated with said sidewall adjacent said upper rim and adapted to be manually displaced in a direction perpendicular to said axis to puncture the side of a metal beverage can positioned with said confining compartment, said puncturing means having a hollow conduit which permits egress of beverage from said can, compressible sealing means disposed upon the interior surface of said sidewall in association with said puncturing means to prevent egress of beverage from other than said hollow conduit, and (d) an elongated tubular nozzle in parallel disposition to said side wall, having a lower extremity which communicates with said conduit, and an open upper extremity directed above said upper rim.

2. The device of claim 1 wherein the confining compartment is of substantially monolithic construction, having been fabricated by molding with a plastic material.

3. The device of claim 2 wherein said plastic material is a thermoplastic polymer having resilient properties and resistance to breaking with minor flexing.

4. The device of claim 1 wherein the sidewall of the confining compartment is of substantially circular cylindrical contour having a diameter slightly larger than the diameter of said beverage can.

5. The device of claim 1 wherein said puncturing means is a pointed tube which also serves as the conduit for egress of beverage.

6. The device of claim 1 wherein a button-type structure is positioned upon the exterior surface of the sidewall in association with the puncturing means.

7. The device of claim 1 wherein the tubular nozzle is located within said sidewall.

8. The device of claim 1 wherein an elongated recess extends perpendicularly to said gap and in communication therewith adjacent said bottom retaining means.

* * * * *